US005554201A

United States Patent [19]

Yagaki et al.

[11] Patent Number: 5,554,201

[45] Date of Patent: Sep. 10, 1996

[54] THERMAL TREATED COAL, AND PROCESS AND APPARATUS FOR PREPARING THE SAME

[75] Inventors: Kazuhito Yagaki; Osamu Okuma; Takuo Shigehisa; Tetsuya Deguchi, all of Kobe, Japan

[73] Assignee: Kabushiki Kaisha Kobe Seiko Sho, Kobe, Japan

[21] Appl. No.: 364,754

[22] Filed: Dec. 27, 1994

[30] Foreign Application Priority Data

Dec. 27, 1993 [JP] Japan ..... 5-331731

[51] Int. Cl.[6] ..... C10L 1/32; C10L 9/00

[52] U.S. Cl. ..... 44/626; 44/282; 44/621

[58] Field of Search ..... 44/626, 282

[56] References Cited

U.S. PATENT DOCUMENTS

| | | | |
|---|---|---|---|
| 4,057,399 | 11/1977 | Cole et al. | 44/626 |
| 4,309,192 | 1/1982 | Kubo et al. | 44/626 |
| 4,514,912 | 5/1985 | Janusch et al. | 44/626 |
| 4,769,042 | 9/1988 | Ito et al. | 44/626 |
| 5,035,721 | 7/1991 | Atherton | 44/626 |
| 5,256,169 | 10/1993 | Roe | 44/626 |

*Primary Examiner*—Ellen M. McAvoy
*Attorney, Agent, or Firm*—Fisher & Associates

[57] ABSTRACT

Thermal treated coal which has a water content of not more than 10%, which has pores with an oil adsorbed onto and impregnated into the pore surface, and which is decarboxylated and dehydrated to have a reduced porosity is provided. In its manufacture, porous coal and an oil are mixed to prepare a slurry, and the slurry is heated for effecting slurry dewatering. During the slurry dewatering, oil is adsorbed onto the surface of the pores of the porous coal. Subsequently, the slurry is heated for refining, followed by a solid-liquid separation at the final stage.

13 Claims, 2 Drawing Sheets

C : MOISTURE FREE COAL
W : WATER
O : OIL
WL : WAST WATER SLIGHTLY POLLUTED WITH ORGANIC MATERIALS
WH : WAST WATER HIGHLY POLLUTED WITH ORGANIC MATERIALS
$CO_2$ : CARBON DIOXIDE GAS

C : MOISTURE FREE COAL
W : WATER
O : OIL
WL : WAST WATER SLIGHTLY POLLUTED WITH ORGANIC MATERIALS
WH : WAST WATER HIGHLY POLLUTED WITH ORGANIC MATERIALS
$CO_2$ : CARBON DIOXIDE GAS

THERMAL TREATED COAL, AND PROCESS AND APPARATUS FOR PREPARING THE SAME

BACKGROUND OF THE INVENTION

1. Field of the Invention

The present invention relates to a technique of thermally refining a porous coal having a high oxygen content. More particularly, the invention relates to a technique of thermally refining low rank porous coal, which is considered to be of low economic value due to its high water content, by effectively dewatering the coal and allowing an oil to be adsorbed onto the pore surface of the coal to eliminate the risk of spontaneous combustion of the coal, and also by decarboxylating and chemically dehydrating the coal to decompose or to release oxygen-containing groups such as carboxy or hydroxy of the raw coal to reduce the porosity of the porous coal.

2. Description of the Related Art

Porous coal tends to contain a considerable amount, for example 30 to 70% by weight of water depending on its porosity. If the porous coal of such a high water content is to be transported, for example, to industrial area, it requires a relatively high transportation cost as if water itself were transported, so that the it is only viable to use porous coal near coal fields. Therefore, it has been accepted that porous coal cannot be utilized other than in the vicinity of the coal field. A typical example of porous coal having a high water content is brown coal.

Although certain brown coals have favorable characteristics such as having low ash and sulfur contents, they tend to have a higher water content because of their porosity. If the water content exceeds 30% by weight, the transportation costs increase considerably, and calorific value decreases commensurate with the higher water content, or higher oxygen content in the dry state. Therefore, brown coals are categorized as low rank coals, notwithstanding the above-mentioned favorable characteristics. This is a problem not only with brown coals, but also with lignite and sub-bituminous coal. Although a description will be given taking brown coals as an example in this specification, it should be borne in mind that the present invention is applicable to any porous coals including lignite and sub-bituminous coal. In addition, the invention is applicable to any brown coals including Victorian coal, North Dakota coal, Beluga coal, etc., irrespective of their production districts as long as they are porous and have a high water content.

In light of decreasing energy resources, techniques for effectively utilizing brown coal have been studied. Thermal refining of brown coal is known as one such technique. This technique is advantageous in that spontaneous combustion is inhibited since the pores of the coal shrink as a decarboxylating/dehydrating reaction proceeds to expel water. However, because raw brown coal containing a great amount of water is treated with heat in the thermal refining process, it is necessary that the heating process must be kept above water vapor pressure which is very high. Moreover, since the dewatering process involves a pyrosis reaction, the waste water discharged therefrom contains a number of organic components which increase the burden of waste water treatment. Therefore, a practical technique for utilizing porous coals by thermal treatment is yet to be realized.

SUMMARY OF THE INVENTION

Accordingly, a primary object of the present invention is to provide thermal treated coal using a method of effectively dewatering and thermally treating low rank coal at a low pressure, in which energy consumption, the load on equipment, the burden of waste water treatment, etc. is reduced.

More particularly, the invention provides heat treated coal which has a water content of not more than 10%, which has pores with an oil adsorbed onto and impregnated into the surface thereof, and which is obtained by decarboxylating and dehydrating a raw coal to remove oxygen.

A further object of the invention is to provide a process and an apparatus for manufacturing thermally refined coal without the aforementioned drawbacks in thermal efficiency, dewatering efficiency, facilities, etc.

Specifically, the invention provides a process in which an oil and a porous coal are mixed to prepare a starting slurry, which is heated to liberate water from the porous coal and to induce an oil into the pores of the porous coal, the resulting treated slurry is refined by further heating, and then a thermally refined coal is separated from the thermal treated slurry by solid-liquid separation. The invention also provides an apparatus for effecting this process.

The above and other objects, features, and advantages of the present invention will become apparent from the following description.

DESCRIPTION OF PREFERRED EMBODIMENTS

Figure 1:
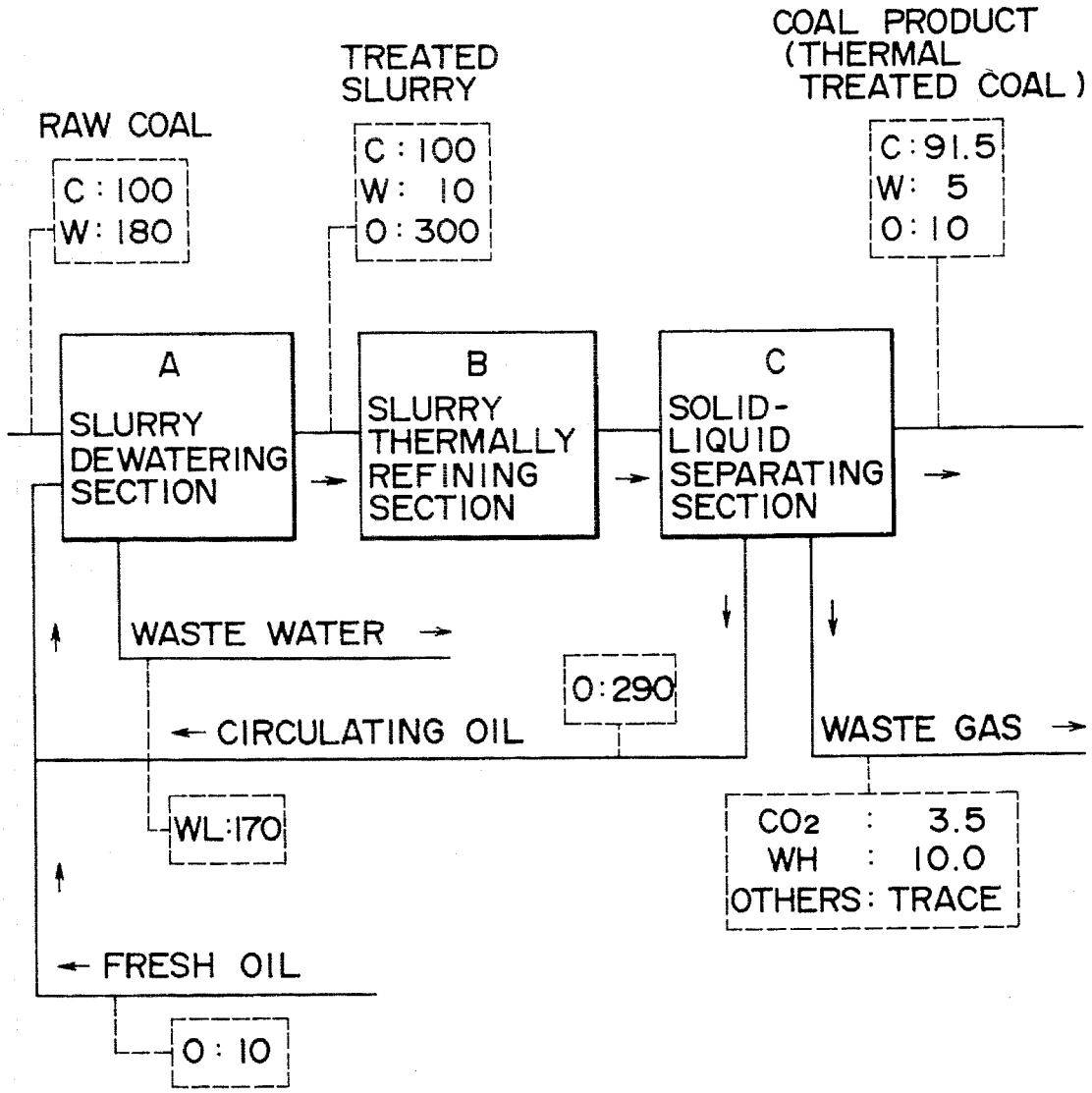
FIG. 1 is a scheme showing one embodiment of the process of the present invention along with a material balance.

The thermal treated coal provided by the present invention has a water content of 10% or less. Moreover, an oil has been adsorbed onto and impregnated into the walls of pores of the coal. The carboxyl groups and hydroxyl groups contained in the starting coal are decomposed by a decarboxylating reaction or dehydrating reaction to reduce the oxygen content. In the present invention, as a result of adsorption and impregnation of an oil onto or into the surface of the pores, thermal treated coal having a smaller risk of spontaneous combustion can be obtained. Since the pore volume is significantly reduced as the decarboxylating reaction/dehydrating reaction proceeds, the amount of the oil adsorbed will not become excessive. Therefore, economic requirements are met in this respect, too. The oil content of the thermal treated coal is preferably from 0.5 to 30%, more preferably from 2 to 15% by weight with respect to the weight of the raw coal on a moisture free basis. The oil preferably contains a dominant proportion of heavy oil fractions. In order to prepare the above-described thermal treated coal, an oil and a porous coal are mixed to prepare a starting slurry. The starting slurry is heated to accelerate slurry dewatering of the porous coal while allowing the oil to enter the pores of the coal. The thus obtained treated slurry is further heated for thermal refining, followed by solid-liquid separation to separate a thermal treated coal. The solid-liquid separation is carried out employing at least one of the following steps; settling, centrifugal separation, filtration, and expression. The waste oil discharged during the step of solid-liquid separation of the treated slurry may be recycled for use as the medium for making a starting slurry. Moreover, the water vapor generated during dewatering of starting slurry may be recovered, pressurized and used for heating the starting slurry. It is recommended that the oil for making the starting slurry be a petroleum derived oil having a boiling point not lower than 100° C., and containing 0.5 to 20% by weight of a heavy oil fraction based on the weight of the raw coal on a moisture free basis. Further, it is also recommended that the oil and porous coal be mixed in a weight ratio of the oil to the porous coal in range of 1:1 to 20:1 (dry coal basis) to prepare a starting slurry, that the starting slurry then be heated and dewatered at a temperature ranging from 100° to 250° C., and that the resulting slurry be thermally refined by being further heated at an elevated temperature ranging from 200° to 350° C.

According to the present invention, an apparatus for the manufacture of the above-described thermal treated coal comprises a mixing tank for preparing a starting slurry by mixing an oil and porous coal, a preheater for preheating the starting slurry, an evaporator for applying heat to the preheated starting slurry to remove water therefrom, a thermal refining vessel for heating the treated slurry from which water has been removed, and a solid-liquid separator which separates the thermal treated coal and the oil. The solid-liquid separator comprises at least following, a settler, a centrifuge, a filter, and an expresser, which may be used singly or in combination. The apparatus may further include a dryer for drying the thermal treated coal which has undergone solid-liquid separation.

A primary feature of the present invention is that dewatering and thermal refining are carried out separately. Since dewatering is carried out in a liquid phase (slurry dewatering), pores of the coal effectively intake oil during dewatering. The thus prepared dewatered coal is then subjected to a thermal refining step. As a result, there is no need for elevating the pressure in the thermal refining system during the treatment, which had been required in the past due to the presence of excessive water content. Thus, thermal refining as a whole can be performed under low pressures. In the thermal refining procedure, carboxyl groups and hydroxyl groups which are present in the porous coal are eliminated during the decarboxylating/dehydrating reaction the coal undergoes. This reaction significantly reduces the volume of the pores, and as a result, the oil adsorbed onto and impregnated into the surface of the pores can be recovered. In addition, the solid-liquid separation performance can be enhanced. Consequently, costs which might be incurred as a result of an increase in the amount of adsorbed oil can be suppressed. In the present invention, any kinds of oils can be used as long as they do not hinder the decarboxylating reaction. However, in view of the fact that it is advantageous to perform slurry dewatering prior to thermal refining, and that it is during this slurry dewatering that oil is adsorbed onto and impregnated into the surface of the pores of the coal to eliminate the risk of spontaneous combustion of porous coal, the below-described oils are recommended.

(a) Oils having a boiling point higher than that of water, and (b) Oils having a boiling point higher than that of water and containing heavy oil fractions inherently or as a result of addition thereto.

In this specification, the term "heavy oil fractions" is used to refer to those which stay within the porous coal as a result of selective adsorption onto the pore surface of the coal to render the porous coal stable. Specifically, examples of the heavy oil fractions include petroleum asphalt, natural asphalt, coal-derived heavy oils, and oils which primarily contain any of these. Examples of those oils (B) which contain heavy oil fractions include 1) petroleum-derived heavy oils, 2) petroleum-derived light oil fractions, kerosene fractions, and lubricating oils which have not undergone a refining process and therefore contain heavy oil fractions, 3) coal tar, 4) light oils and kerosene which have been used as a washing oil and as a result contain contaminants of heavy oil fractions, and 5) hot oils which have been repeatedly used and as result contain deteriorated fractions. On the other hand, examples of those oils (B) to which heavy oil fractions have been added include 1) petroleum-derived light oils, kerosene, and lubricating oils, to which petroleum asphalt, natural asphalt, coal-derived heavy oils, petroleum-derived or coal-derived bottom residues, or oils which primarily contain these have been added. The oils may be either petroleum-derived oils or coal-derived oils. However, petroleum-derived oils are notably advantageous in that 1) they make waste water treatment easy because hydrophilic oils are not contained therein, and thus less oils are included in the separated waste water after the step of slurry dewatering, and 2) they make solid-liquid separation after the step of slurry dewatering easy because of their reduced affinity with porous coal.

Spontaneous combustion of porous coal is considered to occur from the following reaction mechanism. When moisture present in pores of porous coal is removed under dry conditions, the surface of the pores contact outside air. As a result, oxygen gas in the air is allowed to invade the pores and to be adsorbed onto the surface of the pores, to cause oxidation which results in elevation of the temperature and combustion. In the present invention, spontaneous combustion is inhibited because slurry dewatering is employed. In detail, the oil and porous coal are mixed into a slurry, and the resulting slurry is heated at a temperature range from 100° to 250° C. Under such conditions, moisture in the pores is evaporated, and as its replacement, the oil enters the pores. Even if a certain amount of water vapor remains in the pores, the surface of the pores are gradually covered by the oil as the oil is imbibed into the pores by the negative pressure applied during the process of cooling, and eventually most of the pore openings are filled with the oil. Consequently, the outside air is blocked from contacting the surface of the pores. In addition, since carboxyl groups are eliminated by the subsequent thermal refining step, pores are shrunk even more. Therefore, the volume of the pores are considerably reduced, minimizing the risk of spontaneous combustion. Moreover, part of the adsorbed oil or impregnated oil can be recovered as result of the reduction of porosity, leading to an increase in the total amount of oil recovered. Thus, the present invention provides novel and excellent thermal treated at reduced costs.

In short, the thermal treated coal obtained in the present invention has much less chance of spontaneous combustion since the pores are sealed with oil by the slurry dewatering prior to the thermal treatment step. In addition, the decarboxylating/dehydrating reaction greatly reduces the porosity.

In the slurry dewatering and the thermal refining according to the present invention, the lower limit of the range of preferable mixing ratios between the oil and porous coal is determined taking into account the pump transportation performance and the requirement of maintaining a level of fluidity that does not impede heat exchange of the formed slurry. The upper limit is determined taking into acount the increased costs accompanying increases in the amount of oil used. Specifically, the weight ratio of the oil to the coal (dry coal basis) is set in the range from 1:1 to 20:1. The target dewatering rate in the step of slurry dewatering is desirably set as high as possible so that the increase in the pressure needed in the subsequent thermal refining step can be avoided as much as possible. Thus, a dewatering rate of not less than 90% is desirable The temperature during the slurry dewatering step is recommended to be not lower than 100° C. but not higher than the thermal stabilization temperature of the porous coal. Specifically, the temperature range is from 100° to 250° C., and preferably from 120° to 200° C.

The slurry which has undergone the slurry dewatering step may be transferred as it is to the downstream thermal refining process as shown in the embodiment section below. If necessary, solid-liquid separation is performed by suitable means, and the separated oil is recycled and used again in the step of making a starting slurry. At the same time, only the dewatered coal is transferred to the thermal refining process, where the dewatered coal is mixed with a circulating oil which is specifically provided for making a slurry to be subjected to the thermal refining process. Although the latter procedure involves an increase in the complexity of the process, it also has an advantage that hydrophilic components in the circulating oil of the slurry dewatering system are reduced to lighten the burden on waste water treatment equipment.

As described above, either dewatered slurry as it is or a slurry made by mixing with an oil for this particular purpose after the dewatered slurry is subjected to solid-liquid separation can be treated with heat in the thermal refining process. The temperature for thermal refining is generally somewhat higher than that employed for the slurry dewatering, and somewhat lower than the heat decomposition temperature. Specifically, a temperature in the range from 200° to 350° C. is recommended. The operative pressure in the thermal refining step may be low, and a pressure in the range from 1 to 10 atm is recommended. This low pressure is possible because water content is low in this step. In the thermal refining step, carboxyl groups and hydroxyl groups are eliminated from the chemical structure of the porous coal, and the pores are shrunk to reduce its porosity. Consequently, the more oil can be recovered, the calorific value per unit weight increases, and the risk of spontaneous combustion drops, thereby obtaining a thermal treated coal with excellent handling ability and transportation efficiency.

Embodiments:

FIG. 1 shows a exemplary scheme of the process for manufacturing thermal treated coal of the present invention along with a possible material balance. In FIG. 1, 280 parts of a starting coal (100 parts of moisture free coal and 180 parts of water, which make a water content of 64% by weight) and 300 parts of an oil consisting of 290 parts of a circulating oil and 10 parts of a fresh oil are supplied to a slurry dewatering section A through a mixing section and a preheating section, which are not illustrated. In section A, a slurry dewatering treatment is carried out under the conditions of 140° C. and 4 atm. 170 parts of waste water only slightly polluted with organic materials are separated and evaporated. In the meantime, the treated slurry (100 parts of the moisture free coal, 10 parts of water, and 300 parts of oil) is supplied to a slurry thermal refining section B, where thermal refining proceeds at 250° C. and 3 atm. The slurry which has undergone the thermal refining treatment is transferred to a solid-liquid separating section C, where circulating oil (290 parts) and waste gas (3.5 parts of carbon dioxide gas and 10 parts of waste water vapor polluted with organic materials) are separated to yield thermally refined coal (91.5 parts of moisture free coal, 5 parts of water, and 10 parts of oil) as a target product.

Next, a description will be given of an example of the apparatus for the manufacture of thermal treated coal according to the present invention with reference to FIG. 2.

Figure 2:
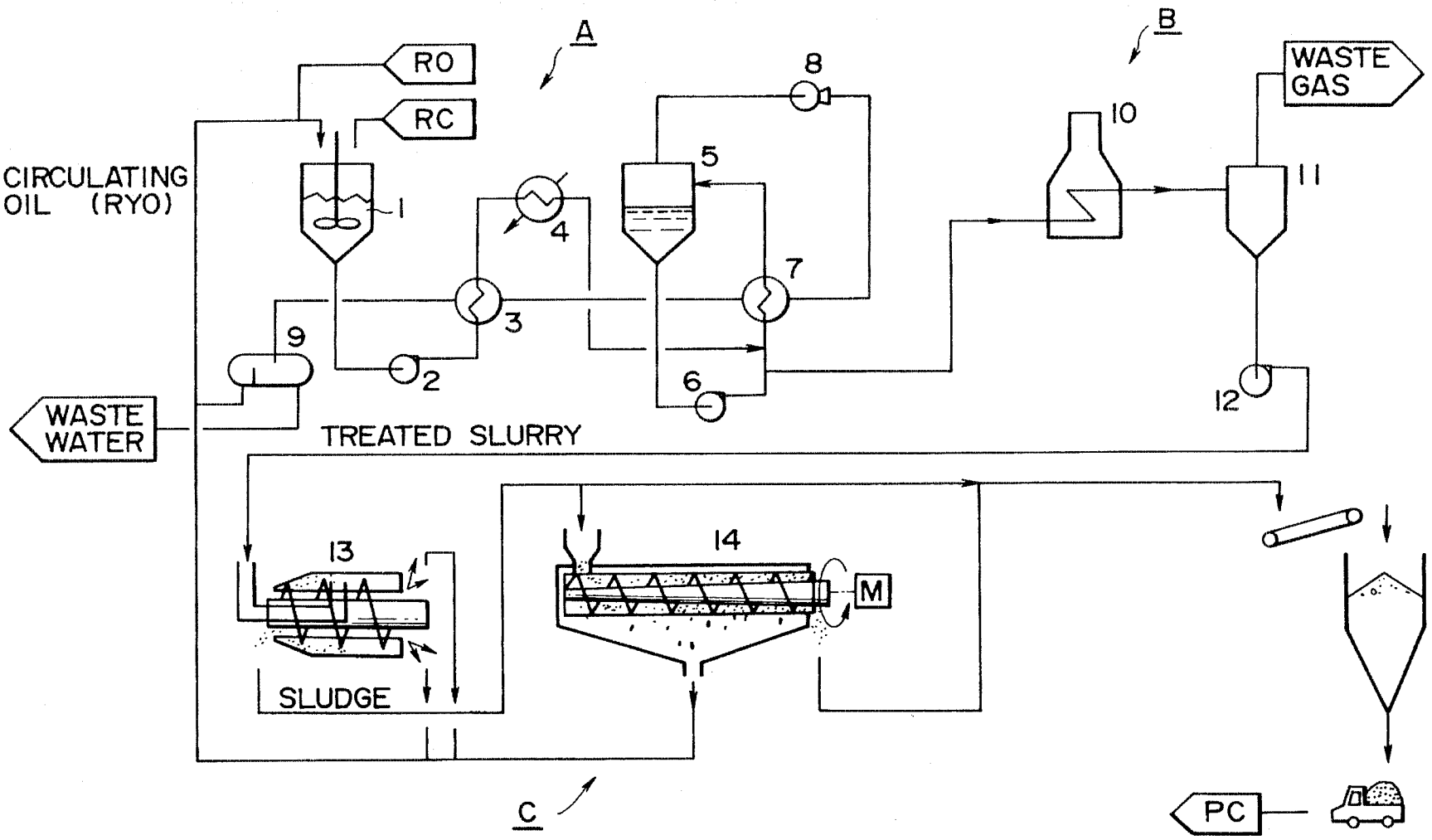
FIG. 2 is a schematic diagram of one embodiment of the apparatus of the present invention.

In FIG. 2, A is a slurry dewatering section, B is a thermal refining section, and C is a solid-liquid separating section. If necessary, a final-stage drying section may be included in the apparatus downstream of C.

Section A (slurry dewatering section) comprises a mixing tank 1 and an evaporator 7 as main components. A crushed sample of porous coal RC and a starting oil RO are charged into mixing tank 1 and are stirred to make a slurry. FIG. 2 depicts an embodiment in which the oil separated in solid-liquid separating section C is used as a circulating oil (RYO), and therefore, a great amount of starting oil RO is required to be charged when operation of this apparatus is started for the first time. However, once the apparatus reaches a stage of a continuous operation, only a replenishing amount of starting oil RO sufficient to compensate for the amount of RO taken away by the final product of this process, is required. Moreover, it is to be noted that heavy oil fractions present in a mixed oil (RO+RYO) for making a slurry are selectively adsorbed onto the surface of the pores of porous coal RC, and therefore, they are carried away by product coal PC. Accordingly, starting oil RO can be heavier oil than circulating oil RYO.

The starting slurry made by sufficient stirring and mixing in mixing tank 1 is transported to evaporator 7 after passing through pump 2 and preheaters 3 and 4. In evaporator 7, the slurry is heated at temperature in the range of 100° to 250° C. During heating, slurry dewatering proceeds and the oil invades the pores of the porous coal and is adsorbed onto the surface of the pores. According to an example in which raw brown coal having a water content of 65% by weight was used along with an oil containing heavy oil fractions weighing 3 times the weight of the dried brown coal, the water content of the coal was surprisingly reduced to not more than 6.5% by weight by the slurry dewatering step.

The thus prepared dewatered slurry of porous coal to which the oil has been adsorbed is transported to vapor-liquid separator 5 for separating the vapor, and then the residual material is withdrawn from the bottom of the separator 5 by a pump 6. The transportation line is split downstream of the pump 6, and a branch line is connected to evaporator 7 to elevate the temperature of the material, after which the material is returned to the vapor-liquid separator 5. In the meantime, the water vapor generated in evaporator 7 and separated by vapor-liquid separator 5 is pressurized in compressor 8, and its thermal energy with high calories is utilized for heating the slurry in evaporator 7 to perform slurry dewatering. The pressurized water vapor phase is subsequently transported to a preheater 3 and is used as a heat source for preheating. Thereafter, the waste water separated from the oil by oil-water separator 9 is discarded. The oil recovered by the oil-water separation is returned to mixing tank 1 for reuse, though the amount of returned oil is not significant.

Most of the slurry pumped up by pump 6 is transferred to a thermal refining device 10 of thermal refining section B. In device 10, the slurry is thermally refined though a decarboxylating/dehydrating reaction. The thermally refined slurry is then forwarded to vapor-liquid separator 11, where waste gas such as carbon dioxide gas generated from the decarboxylating/dehydrating reaction is liberated. Thereafter, the slurry is transferred to solid-liquid separating section C. In section C, the slurry is first condensed by a centrifugal separator 13 and then expressed using a screw press 14. By this time, porous coal in the slurry has come to have a reduced porosity due to thermal refining, and as a result, solid-liquid separability is remarkably good. Therefore, thermally refined coal can be obtained without subjecting it to a further final-stage drying except for special cases. The oil obtained from the step of solid-liquid separation is returned to section A as a circulating oil.

As described above, the apparatus and process of the present invention enable effective slurry dewatering and thermal refining with facility costs and energy consumption being suppressed at low levels. As a result, thermal treated coal of high quality can be obtained. Specifically, oil is fully adsorbed onto and impregnated into the pore walls of porous coal during slurry dewatering, and in addition, decarboxylating/dehydrating reaction serves to reduce the porosity of the coal. According to the invention, the thermal refining step is effected after the slurry dewatering step, making it possible to suppress the operative pressure in the thermal refining step. In addition, there is no chance of discharging a considerable amount of water polluted with organic materials of high concentration in the thermal refining step. Also, reduced porosity greatly facilitates the solid-liquid separation and recovery of the oil, resulting in reduced costs.

What is claimed is:

1. A thermally treated coal having a water content of not more than 10%, said coal being formed from the process comprising the steps of:

providing a porous coal;

providing an oil for impregnating pores of the porous coal;

mixing the coal and the oil to obtain a slurry;

heating the slurry, said step of heating including steps of evaporating water from the porous coal and inducing impregnation of the oil into the pores of the coal; and thermally treating the heated and dewatered slurry, said step including at least a step of decarboxylating the oil-impregnated coal through heating to remove oxygen therefrom.

2. The thermally treated coal according to claim 1, wherein an oil content of the thermally treated coal is from 0.5 to 30% by weight on a moisture free basis.

3. The thermally treated coal according to claim 1, wherein the step of providing an oil for impregnating the coal includes the steps of providing an oil mixture having a heavy oil fraction for impregnating the pores of the coal and a solvent fraction for dispersing the heavy oil fraction to impregnate the pores of the coal.

4. A process for manufacturing a thermally treated coal which comprises the steps of:

providing a porous coal;

providing an oil for impregnating pores of the porous coal;

mixing the oil and the porous coal to obtain a starting slurry;

heating the starting slurry, said step of heating the starting slurry including steps of evaporating water from the porous coal and inducing impregnation of the oil into the pores of the coal;

thermally treating the resulting heated slurry, said step of thermally treating the resulting heated slurry including at least a step of decarboxylating the oil-impregnated coal through heating to remove oxygen therefrom; and then separating a thermally refined coal from the thermally treated slurry by solid-liquid separation.

5. The process for manufacturing a thermally treated coal according to claim 4, wherein said step of separating the thermally refined coal by solid-liquid separation includes using at least one of settling, centrifugal separation; filtration, and expression to effect said soli-liquid separation.

6. The process for manufacturing a thermally treated coal according to claim 4, wherein the oil recovered during the solid-liquid separation is recycled for use as a medium for making the starting slurry.

7. The process for manufacturing a thermally treated coal according to claim 4, wherein the water vapor during the dewatering of the starting slurry is recovered and pressurized for use as a heat source for heating the starting slurry.

8. The process for manufacturing a thermally treated coal according to claim 4, wherein the oil used for the preparation of the starting raw slurry is a petroleum derived oil having a boiling point not lower than 100° C. and comprising a heavy oil fraction.

9. The process for manufacturing a thermally treated coal according to claim 8, wherein said step of mixing the oil and porous coal includes mixing in a ratio such that the amount of the heavy oil fraction impregnated into the coal is 0.5 to 20% by weight on a moisture free basis.

10. The process for manufacturing a thermally treated coal according to claim 4, wherein said step of mixing the oil and the porous coal includes mixing in a weight ratio of the oil to the porous coal in the range of 1:1 to 20:1 to prepare the starting slurry, said step of heating the starting slurry includes heating and dewatering at a temperature ranging from 100° to 250° C., and said step of thermally treating the resulting slurry includes heating the resulting slurry at an elevated temperature ranging from 200° to 350° C.

11. An apparatus for manufacturing a thermally treated coal, comprising:

a mixing tank for mixing a porous coal with an oil for impregnating pores of the porous coal to thereby prepare a starting slurry;

a preheater for preheating the starting slurry;

an evaporator for applying heat to the preheated starting slurry to remove water therefrom;

a thermal treating heater means for at least thermally decarboxylating the dewatered slurry; and a solid-liquid separator means for separating thermal treated coal from the dewatered and thermally decarboxylated slurry.

12. The apparatus according to claim 11, wherein the solid-liquid separator comprises at least one of a settler, a centrifuge, a filter, and an expresser.

13. The apparatus according to claim 11, further comprising dryer for drying the thermal treated coal which has undergone solid-liquid separation.

* * * * *